US008082842B2

(12) United States Patent
Gervasi et al.

(10) Patent No.: US 8,082,842 B2
(45) Date of Patent: Dec. 27, 2011

(54) PERFLUORINATED POLYETHER RELEASE AGENT FOR PHASE CHANGE INK MEMBERS

(75) Inventors: David J. Gervasi, Penfield, NY (US); Bryan J. Root, Fairport, NY (US); Santokh S Badesha, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 1530 days.

(21) Appl. No.: 11/445,387

(22) Filed: May 31, 2006

(65) Prior Publication Data

US 2007/0277690 A1 Dec. 6, 2007

(51) Int. Cl.
*G03G 15/20* (2006.01)

(52) U.S. Cl. ..... 101/141; 399/325; 399/328; 101/142

(58) Field of Classification Search ..... 101/368, 101/141, 142; 399/266, 324, 325, 333, 328
See application file for complete search history.

(56) References Cited

U.S. PATENT DOCUMENTS 4,430,406 A 2/1984 Newkirk et al.
4,743,300 A * 5/1988 Brinduse et al. ..... 106/38.22
5,210,123 A * 5/1993 Caporiccio ..... 524/263
5,736,250 A * 4/1998 Heeks et al. ..... 428/447
5,777,650 A * 7/1998 Blank ..... 347/103
6,918,664 B2 * 7/2005 Pan et al. ..... 347/103
2003/0232945 A1 * 12/2003 Pickering et al. ..... 528/10
2003/0234837 A1 * 12/2003 Pan et al. ..... 347/84

* cited by examiner

*Primary Examiner* — Joshua D Zimmerman
*Assistant Examiner* — Shema Freeman
(74) *Attorney, Agent, or Firm* — MH2 Technology Law Group LLP

(57) ABSTRACT

An offset printing apparatus for transferring a phase change ink onto a print medium, which includes a) a phase change ink component for applying a phase change ink in a phase change ink image; b) an imaging member for accepting the phase change ink image from the phase change ink component, and transferring the phase change ink image from the imaging member to the print medium, the imaging member having i) an imaging substrate, and thereover ii) an optional outer layer; and iii) iii) a release agent material coating, wherein the release agent material coating includes a perfluorinated polyether having a skeleton selected from the group consisting of Formulas I and II and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

and $$R_1—(CF_2CF_2)_m—O—(R_2R_2O)_n—(R_2O)_p—(CF_2)_q—CF_3—R_1 \quad \text{Formula II.}$$

20 Claims, 1 Drawing Sheet

PERFLUORINATED POLYETHER RELEASE AGENT FOR PHASE CHANGE INK MEMBERS

CROSS REFERENCE TO RELATED APPLICATIONS

Reference is made to co-pending, commonly assigned U.S. patent application Ser. No. 11/444,559, entitled "Perfluorinated Polyether Release Agent for Fuser Members." The application is hereby incorporated by reference in its entirety.

BACKGROUND

Disclosed herein are phase change ink imaging, transfix or transfuse members useful in ink jet, such as phase change ink or solid ink jet apparatuses. The imaging members can be imaging, transfix, transfuse, or the like, members useful in ink jet machines. In an embodiment, the release agent is a perfluorinated polyether release agent. In embodiments, the release agent has pendant functional groups. In embodiments, the release agent comprises a functional perfluorinated polyether material and a functional silicone material.

U.S. Pat. No. 6,695,904 teaches use of a perfluoroalkyl polyether as a release agent.

U.S. Pat. No. 4,430,406 teaches use of perfluoroalkyl polyethers as release agents.

Maintaining release surfaces in various marking engine subsystems is approached in a variety of manners, most often by use of release agents. Release agents wet surfaces in marking engines by physical or chemical means, providing a continuous barrier to toner, ink, and additives. The release agent is replenished by release agent management (RAM), drum maintenance (DM) or translating web oiling systems.

The following are shortfalls in performance, and are barriers to increased release life, expansion of high-speed color marking, and reduction of total cost of ownership to customers (TCO). To begin with, chemical and physical interactions between silicone release agents and toner and/or ink constituents leads to insufficient releasability.

In some commercial high-speed black and white products, fluorine-substituted silicones have been used as release agents at very low levels (<1 mg/pg) for enhanced performance. For many known marking engines, silicone-based release fluids are used because of their thermal stability and by virtue of the facility for functional side chain addition to silicone fluids used for chemical anchoring to substrates. These fluorine-substituted silicones provide fluids with enhanced resistance to interaction with ink and ink components, but are limited to specific applications and subsystem materials sets.

Fluorinated fluids, due to their non-interactivity with other materials, will allow an overall reduction in oil usage. The non-interactive nature increases their effectiveness as release fluids. In addition, these fluids can be effectively filtered and reused, which is an improvement over silicone fluids. Silicones interact so extensively with ink and wax ingredients, that gelation rates and viscosity increase while residing in the sump.

The performance of several end use applications in high-speed color printing is compromised by the residual silicone oil that remains on the surface of the print after fusing. Experience has demonstrated that fluorine-substituted silicone fluids avoid this issue because they diffuse into the paper faster than amine-functional silicone fluids, as they do not bond with paper fibers and fillers. Therefore, non-interactive fluorinated fluids should improve end use performance in printing applications where bookbinding adhesives, overcoat varnishes, and other end use processing is a consideration.

Several marking technologies use functional silicone release fluids in order to aid the wetting of the release surface by chemical means. This functionality is multi-faceted in nature, in that it can fortify the release layer through the chemical attachment of functional groups to the surface, it enables more uniform coverage of the release layer, and it can improve wetting of the release fluids that may not wet/spread as effectively or as quickly as they would without the benefit of functionality. The foremost example of functional release fluids is amine functional silicone, commonly used in conjunction with anodized aluminum, fluoropolymer and fluoroelastomer surfaces. As an example, nonfunctional silicone does not inherently spread or wet a fluoroelastomer surface well at the nominal viscosity and temperature ranges suited to the application. The silicone is easily removed from the surface and its wetting behavior does not allow it to wet as uniformly or tenaciously as is necessary for sustained release performance. When the release fluid fails, ink or toner can then contact the drum surface, resulting in numerous shortfalls in performance, such as transfer offset failures.

Amine functional silicone consists of a blend of nonfunctional and functional components. The amine functional component is renewable and replenishable, and can both create and bond with unsaturation in polymer backbones. This enables the spread and release performance of the non-functional component, which spreads and remains by virtue of chain entanglement and affinity between the functional and non-functional parts.

Analogous to the previously described situation is the use of functional perfluorinated polyether (PFPE) or other fully fluorinated fluids as release agents. The defects and maintenance requirements associated with these failure modes when used with silicone oil necessitate increased user intervention, increased cost of operation, and more complex system designs. The root cause of many failures in marking systems requiring release agents is the interaction and solubility between toner and ink constituents and the silicone release agent. This interaction and its effects on system performance have been extensively studied and mapped. The use of non-interactive PFPE fluids as release agents in these marking technologies can eliminate these interactions and provide a renewable, through effective filtration, release agent to improve subsystem life and reliability, thereby reducing maintenance and run costs.

There exists a need for a release agent to be used in color marking applications where higher speed, improved release life, and/or cost reduction is desirable. While these fluorinated fluids may be used in their currently commercially available configuration, without additional functionality, more demanding applications may warrant the use of functionalized versions of fluorinated fluids. Such functional molecules are known and can be prepared in a manner described in the following article: Tonelli Claudio, Gavezotti Piero and Strepparola Ezio. Linear perfluoropolyether difunctional oligomers: chemistry, properties and applications Journal of Fluorine Chemistry, Volume 95, Issues 1-2, 4 Jun. 1999, Pages 51-70.

In addition, a need still exists for a release agent, which provides sufficient wetting of the imaging member, but still has little or no interaction with copy substrates such as paper, so that the release agent does not interfere with adhesives and POST-IT® notes (by 3M) adhering to the copy substrate such as paper. It is further desired that the oil not prevent ink adhesion to the final copy substrate. In addition, it is desired that the release agent not react with components of the ink.

Also, it is desired to provide a release agent that enables increase in life of the imaging member by improved spreading of the release agent.

SUMMARY

Embodiments include: an offset printing apparatus for transferring a phase change ink onto a print medium comprising a) a phase change ink component for applying a phase change ink in a phase change ink image; b) an imaging member for accepting the phase change ink image from the phase change ink component, and transferring the phase change ink image from the imaging member to the print medium, the imaging member comprising: i) an imaging substrate, and thereover ii) an optional outer layer; and iii) a release agent material coating, wherein the release agent material coating comprises a perfluorinated polyether having a skeleton selected from the group consisting of Formulas I and II and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is selected from the group consisting of $CF_2$, $CF—CF_3$ and $—NR_4R_5$; $R_2$ is selected from the group consisting of $CF_2$, $CF—CF_3$, and $—NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 180 to about 500; and $$R_1—(CF_2CF_2)_m—O—(R_2R_2O)_n—(R_2O)_p—(CF_2)_q—CF_3—R_1 \quad \text{Formula II}$$

wherein $R_1$ is $CF_3$; $R_2$ is selected from the group consisting of $CF_2$ and $CF—CF_3$; m is a number of 0 or 1; n is a number of from about 0 to about 500; p is a number of from about 0 to about 100; q is a number of 0 or 1; and p+n is a number of from about 180 to about 500.

Embodiments also include: an offset printing apparatus for printing a phase change ink onto a print medium comprising: a) a phase change ink component for applying a phase change ink in a phase change ink image; b) an imaging member for accepting the phase change ink image from the phase change ink component, and transferring the phase change ink image from the imaging member to the print medium and for fixing the phase change ink image to the print medium, the imaging member comprising: i) an imaging substrate, and thereover ii) an outer layer comprising a fluoroelastomer; and iii) a release agent material coating, wherein the release agent material coating comprises a perfluorinated polyether having a skeleton selected from the group consisting of Formulas I and II and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is selected from the group consisting of $CF_2$, $CF—CF_3$ and $—NR_4R_5$; $R_2$ is selected from the group consisting of $CF_2$, $CF—CF_3$, and $—NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 180 to about 500; and $$R_1—(CF_2CF_2)_m—O—(R_2R_2O)_n—(R_2O)_p—(CF_2)_q—CF_3—R_1 \quad \text{Formula II}$$

wherein $R_1$ is $CF_3$; $R_2$ is selected from the group consisting of $CF_2$ and $CF—CF_3$; m is a number of 0 or 1; n is a number of from about 0 to about 500; p is a number of from about 0 to about 100; q is a number of 0 or 1; and p+n is a number of from about 180 to about 500.

In addition, embodiments include: an offset printing apparatus comprising:

a) a phase change ink component containing a phase change ink;

b) a imaging member comprising: i) an imaging substrate, and thereover ii) an optional outer layer; and iii) a release agent material coating on the outer layer, wherein the release agent material coating comprises a perfluorinated polyether having a skeleton selected from the group consisting of Formulas I and II and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is selected from the group consisting of $CF_2$, $CF—CF_3$ and $—NR_4R_5$; $R_2$ is selected from the group consisting of $CF_2$, $CF—CF_3$, and $—NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 180 to about 500; and $$R_1—(CF_2CF_2)_m—O—(R_2R_2O)_n—(R_2O)_p—(CF_2)_q—(CF_2)_q—CF_3—R_1 \quad \text{Formula II}$$

wherein $R_1$ is $CF_3$; $R_2$ is selected from the group consisting of $CF_2$ and $CF—CF_3$; m is a number of 0 or 1; n is a number of from about 0 to about 500; p is a number of from about 0 to about 100; q is a number of 0 or 1; and p+n is a number of from about 180 to about 500; and c) a heating member associated with the offset printing apparatus, wherein the phase change ink component dispenses the phase change ink onto the imaging member, and wherein the phase change ink is solid at about 25° C.

BRIEF DESCRIPTION OF THE DRAWINGS

For a better understanding of the present invention, reference may be had to the accompanying figures.

DETAILED DESCRIPTION

Disclosed herein are fuser agents, release agents, fuser oils, and the like, comprising perfluorinated polyethers. The release agents are useful with toner-based printing and copying apparatuses, and with ink (such as solid ink)-based printing and copying apparatuses. Specifically, the release agent comprises a functional perfluorinated polyether (PFPE) fluid to improve the wettability of PFPE on a variety of surfaces. A functional fluid can also be blended with a non-functional PFPE, to be used in a variety of release agent applications.

Ink jet printing systems using intermediate transfer, transfix or transfuse members are well known, such as that described in U.S. Pat. No. 4,538,156. Generally, the transfix printing or intermediate transfer member is employed in combination with a print head. A final receiving surface or print medium is brought into contact with the transfix printing surface after the image has been placed thereon by the nozzles of the print head. The image is then transferred and fixed to a final receiving surface.

The imaging member is multi-functional. First, the ink jet print head prints images on the imaging member, and thus, it is an imaging member. Second, after the images are printed on the imaging member, they can then be transfixed or transfused to a final print medium. Therefore, the imaging member provides a transfix or transfuse function, in addition to an imaging function.

The details of embodiments of phase-change ink printing processes are described in the patents referred to above, such as U.S. Pat. Nos. 5,502,476; 5,389,958; and 6,196,675 B1, the disclosures of each of which are hereby incorporated by reference in their entirety.

Figure 1:
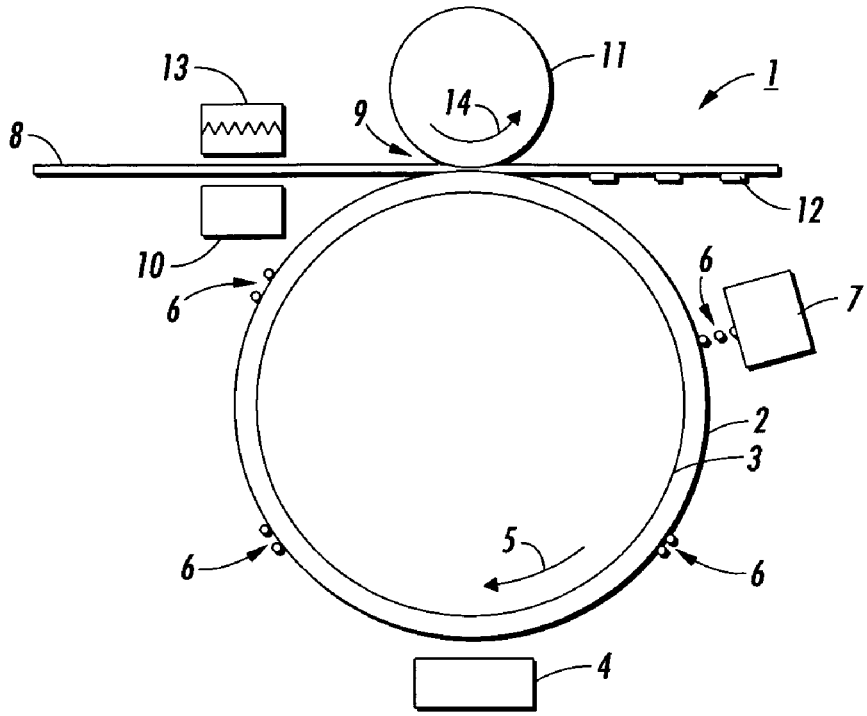
FIG. 1 is an illustration of an embodiment of a transfer printing apparatus using an imaging member in the form of a drum.

Referring to FIG. 1, offset printing apparatus 1 is demonstrated to show transfer of an ink image from the imaging member to a final printing medium or receiving substrate. As the imaging member 3 turns in the direction of arrow 5, a liquid surface 2 is deposited on imaging member 3. The imaging member 3 is depicted in this embodiment as a drum member. However, it should be understood that other embodiments can be used, such as a belt member, film member, sheet member, or the like. The liquid layer 2 is deposited by an applicator 4 that may be positioned at any place, as long as the applicator 4 has the ability to make contact and apply liquid surface 2 to imaging member 3.

The ink used in the printing process can be a phase change ink, such as, for example, a solid ink. The term "phase change ink" means that the ink can change phases, such as a solid ink becoming liquid ink or changing from solid into a more malleable state. Specifically, in embodiments, the ink can be in solid form initially, and then can be changed to a molten state by the application of heat energy. The solid ink may be solid at room temperature, or at about 25° C. The solid ink may possess the ability to melt at relatively high temperatures above from about 85° C. to about 150° C. The ink is melted at a high temperature and then the melted ink 6 is ejected from print head 7 onto the liquid layer 2 of imaging member 3. The ink is then cooled to an intermediate temperature of from about 20° C. to about 80° C., or about 72° C., and solidifies into a malleable state in which it can then be transferred onto a final receiving substrate 8 or print medium 8.

The ink has a viscosity of from about 5 to about 30 centipoise, or from about 8 to about 20 centipoise, or from about 10 to about 15 centipoise at about 140° C. The surface tension of suitable inks is from about 23 to about 50 dynes/cm. Examples of suitable inks for use herein include those described in U.S. Pat. Nos. 4,889,560; 5,919,839; 6,174,937; and 6,309,453, the disclosure each of which are hereby incorporated by reference in their entirety.

Some of the liquid layer 2 is transferred to the print medium 8 along with the ink. A typical thickness of transferred liquid is about 100 angstroms to about 100 nanometer, or from about 0.1 to about 200 milligrams, or from about 0.5 to about 50 milligrams, or from about 1 to about 10 milligrams per print medium.

Suitable liquids that may be used as the transfix print liquid surface 2 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

Feed guide(s) 10 and 13 help to feed the print medium 8, such as paper, transparency or the like, into the nip 9 formed between the pressure member 11 (shown as a roller), and imaging member 3. It should be understood that the pressure member can be in the form of a belt, film, sheet, or other form. In embodiments, the print medium 8 is heated prior to entering the nip 9 by heated feed guide 13. When the print medium 8 is passed between the transfix printing medium 3 and the pressure member 11, the melted ink 6 now in a malleable state is transferred from the imaging member 3 onto the print medium 8 in image configuration. The final ink image 12 is spread, flattened, adhered, and fused or fixed to the final print medium 8 as the print medium moves between nip 9. Alternatively, there may be an additional or alternative heater or heaters (not shown) positioned in association with offset printing apparatus 1. In another embodiment, there may be a separate optional fusing station located upstream or downstream of the feed guides.

The pressure exerted at the nip 9 is from about 10 to about 1,000 psi, or about 500 psi, or from about 200 to about 500 psi. This is approximately twice the ink yield strength of about 250 psi at 50° C. In embodiments, higher temperatures, such as from about 72 to about 75° C. can be used, and at the higher temperatures, the ink is softer. Once the ink is transferred to the final print medium 8, it is cooled to an ambient temperature of from about 20° C. to about 25° C. Stripper fingers (not shown) may be used to assist in removing the print medium 8 having the ink image 12 formed thereon to a final receiving tray (also not shown).

Figure 2:
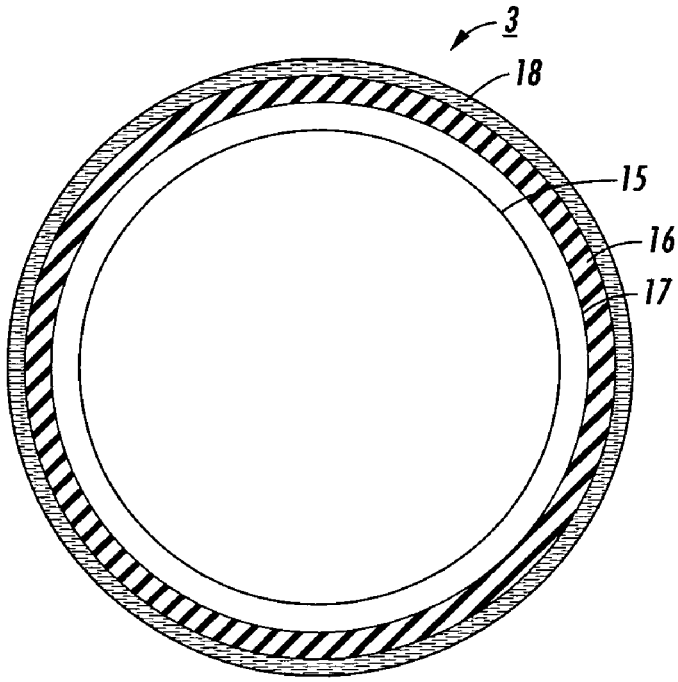
FIG. 2 is an enlarged view of an embodiment of a transfix printing drum having a substrate, and optional intermediate layer, an outer elastomer layer thereon, and a release agent on the elastomer layer.

FIG. 2 depicts a three-layer configuration comprising a substrate 15, intermediate layer 17 positioned on the substrate 15, outer layer 16 positioned on the intermediate layer 17, and release layer 18 positioned on outer layer 16.

Examples of the outer surface of the imaging system members include silicone, urethane, fluoroplastic or fluoropolymers, fluoroelastomers, or silicone-fluoropolymer hybrids. Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures each of which are incorporated by reference herein in their entirety. As described therein, these elastomers are from the class of 1) copolymers of two of vinylidenefluoride, hexafluoropropylene, and tetrafluoroethylene; 2) terpolymers of vinylidenefluoride, hexafluoropropylene and tetrafluoroethylene; and 3) tetrapolymers of vinylidenefluoride, hexafluoropropylene, tetrafluoroethylene and cure site monomer. These are known commercially under various designations as VITON A®, VITON B®, VITON E®, VITON E 60C®, VITON E430®, VITON 910®, VITON GH®; VITON GF®; and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a Trademark of 3M Company. Additional commercially available materials include AFLAS™ a poly (propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, and TN505®, available from Montedison Specialty Chemical Company.

The fluoroelastomers VITON GH® and VITON GF® have relatively low amounts of vinylidenefluoride. The VITON GF® and Viton GH® have about 35 weight percent of vinylidenefluoride, about 34 weight percent of hexafluoropropylene and about 29 weight percent of tetrafluoroethylene with about 2 weight percent cure site monomer.

The amount of fluoroelastomer compound in solution in the outer layer solutions, in weight percent total solids, is from about 10 to about 25 percent, or from about 16 to about 22 percent by weight of total solids. Total solids as used herein include the amount of fluoroelastomer, dehydrofluorinating agent and optional adjuvants and fillers, including metal oxide fillers.

In addition to the fluoroelastomer, the outer layer may comprise a fluoropolymer or other fluoroelastomer blended with the above fluoroelastomer. Examples of suitable polymer blends include the above fluoroelastomer, blended with a fluoropolymer selected from the group consisting of polytetrafluoroethylene and perfluoroalkoxy. The fluoroelastomer can also be blended with non-fluorinated ethylene or non-fluorinated propylene.

Specific examples of outer coatings include those listed in U.S. Pat. Nos. 6,910,765; 6,918,664; 6,843,559; 6,932,470; 6,648,467 and 6,939,000, the disclosures of each of these are incorporated by reference herein in their entirety.

Other coatings suitable for the outer layer include an outer coating comprising an elastomer comprising monomers selected from the group consisting of halogenated monomers, polyorganosiloxane monomers, and polymers thereof. The elastomer is selected from the group consisting of volume grafted fluoroelastomers, ceramers, grafted ceramers, titamers and grafted titamers. The elastomer can also comprises polyorganosiloxane monomers, such as those comprising functionality selected from the group consisting of vinyl, alkoxy and hydrogen functionality, or the elastomer can comprise an additional monomer capable of reacting with said polyorganosiloxane monomer to form a polyorganosiloxane copolymer. For example, the polyorganosiloxane copolymer can be selected from the group consisting of polyamide polyorganosiloxane copolymers, polyimide polyorganosiloxane copolymers, polyester polyorganosiloxane copolymers, polysulfone polyorganosiloxane copolymers, polystyrene polyorganosiloxane copolymers, polypropylene polyorganosiloxane copolymers, and polyester polyorganosiloxane copolymers.

Other suitable outer layers include a thermoplastic such perfluoroalkoxy, polyimide, perfluorovinylalkylether tetrafluoroethylene, polyether, polyester, polypropylene, vinylidene fluoride, polymethyl methacrylate, polyethylene terephthalate, polyethylene naphthalate, poly(vinyl fluoride), polychlorotrifluoroethylene, and mixtures thereof. The polyesters include polyester polydiorganosiloxane, poly(ethylene terephthalate), poly(butylene terephthalate), poly(ethylene naphthoate), and mixtures thereof. Specific polyethers include those is selected from the group consisting of polyether ether ketone, poly(phenylene ether), polyether sulfone, and mixtures thereof. Suitable polypropylenes include poly (ethylene propylene), polystyrene, polyphenylene oxide, and mixtures thereof. Other thermoplastics include a polyvinylidene halide such as those selected from the group consisting of polyvinylidene fluoride and polyvinylidene chloride. Thermoplastics also include polyimides such as polyamideimide, fluorinated polyimide, polyimidesulfone, polyimide polyorganosiloxane, and polyimide ether, and polyamideimide.

Other suitable outer layers include a thermoset such as ceramics and silicones, and include those thermosets selected from the group consisting of thermoset rubbers, urethenes, phenolics, epoxies, alkyds, and mixtures thereof.

Other suitable outer layers include fluorosilicones.

An inorganic particulate filler may be used in connection with the fluoroelastomer outer layer, in order to provide anchoring sites for the functional groups of the silicone release agent. However, a filler is not necessary for use with the present fluorosilicone release agent. In fact, dispensing with a metal oxide increases imaging member life and decreases fabrication costs. Examples of suitable fillers include a metal-containing filler, such as a metal, metal alloy, metal oxide, metal salt or other metal compound. The general classes of metals, which are applicable to the present invention include those metals of Groups 1b, 2a, 2b, 3a, 3b, 4a, 4b, 5a, 5b, 6b, 7b, 8 and the rare earth elements of the Periodic Table. The filler can be an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium, nickel and alloys thereof. Other specific examples include inorganic particulate fillers are aluminum oxide and cupric oxide. Other examples include reinforcing and non-reinforcing calcined alumina and tabular alumina, respectively, along with nanoparticles. The size of the particle may be such that a low weight percent of loading into the polymer coating will provide a higher surface area of contact between the polymer and the filler, providing enhanced reinforcement or functionality.

The thickness of the outer fluoroelastomer surface layer of the imaging member herein is from about 10 to about 250 micrometers, or from about 15 to about 100 micrometers.

Optional intermediate adhesive layers and/or intermediate polymer or elastomer layers may be applied to achieve desired properties and performance objectives of the present invention. The intermediate layer may be present between the substrate and the outer fluoroelastomer surface. An adhesive intermediate layer may be selected from, for example, epoxy resins and polysiloxanes. Examples of suitable intermediate layers include silicone rubbers such as room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Corning; and 106 RTV Silicone Rubber and 90 RTV Silicone Rubber, both from General Electric. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182.

There may be provided an adhesive layer between the substrate and the intermediate layer. There may also be an adhesive layer between the intermediate layer and the outer layer. In the absence of an intermediate layer, the fluoroelastomer layer may be bonded to the substrate via an adhesive layer.

The thickness of the intermediate layer is from about 0.5 to about 20 mm, or from about 1 to about 7 mm.

The release agents or fusing oils described herein are provided onto the outer layer of the imaging member via a delivery mechanism such as a delivery roll. The delivery roll is partially immersed in a sump, which houses the fuser oil or release agent. The oil is renewable in that the release oil is housed in a holding sump and provided to the imaging member when needed, optionally by way of a release agent donor roll in an amount of from about 0.1 to about 20 mg/copy, or from about 1 to about 12 mg/copy, or from about 1 to about 5 mg/copy. The later range encompasses most solid ink and lower oil levels in some applications.

Examples of suitable release agents include those having the following skeletal Formulas I or II:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is $CF_2$, CF—$CF_3$ or —$NHR_4$; $R_2$ is $CF_2$, CF—$CF_3$, or —$NR_4R_5$; and $R_3$ is $CF_2$ or $CF_3$, wherein $R_1$ is selected from the group consisting of $CF_2$, CF—$CF_3$ or —$NR_4R_5$; $R_2$ is selected from $CF_2$ or CF—$CF_3$; $R_3$ is $CF_2$ or $CF_3$; $R_4$ is selected from the group consisting of hydrogen, alkyl group having from about 1 to about 18 carbon atoms or from about 1 to about 8 carbons or from about 1 to about 6 carbons or from about 1 to about 3 carbon atoms, arylalkyl group (with either the alkyl group or the aryl group being attached to the silicon atom) having from about 7 to about 18 carbon atoms or from about 7 to about 9 carbon atoms, mercapto, hydride or carbinol functional group; $R_5$ is selected from the group consisting of alkyl having from about 1 to about 20 carbons or from about 1 to about 10 carbons such as methyl, ethyl, butyl and the like, and a fluoroalkyl having from about 2 to about 10 carbons such as fluoromethyl, fluorobutyl, difluoroethyl, and the like; m is a number of 0 or 1; n is a number of from about 0 to about 500, or from about 200 to about 350; p is a number of from about 0 to about 100 or from about 50 to about 75; q is a number of 0 or 1; and p+n is a number of from about 180 to about 500 or from about 250 to about 425; and $$R_1—(CF_2CF_2)_m—O—(R_2R_2O)_n—(R_2O)_p—(CF_2)_q—CF_2—R_1 \quad \text{Formula II}$$

wherein $R_1$ is $CF_3$; $R_2$ is selected from the group consisting of $CF_2$ and CF—$CF_3$; in is a number of 0 or 1; n is a number of from about 0 to about 500, or from about 200 to about 350; p is a number of from about 0 to about 100, or from about 50 to about 75; q is a number of 0 or 1; and p+n is a number of from about 180 to about 500 or from about 250 to about 425. The alkyl groups above can include including linear, branched, cyclic, and unsaturated alkyl groups.

In embodiments, the release agent has a viscosity of from about 75 to about 1,500 cS, or from about 100 to about 1,000 cS, when the release agent is used with toner. When the release agent is used with a phase change ink, the viscosities are from about 50 to about 200 cS, or from about 10 to about 40 cS.

Alternatively, a blend of functional silicone materials and nonfunctional perfluorinated polyether release agent can be used to combine the advantages of both individual fluids. In embodiments, a functional element can be added to the PFPE fluids in order to provide a replenishable, consistently uniform and non-interactive release fluid for use on variety of surfaces. In embodiments, the use of amine-functional PFPE fluids enables initial wetting performance and potentially sustained performance as this would also improve the wetting behavior of PFPE fluids so that they might wet areas of the imaging member that have been contaminated with ink. This should not, however, compromise the non-interactive nature of the PFPE fluid as the functional level would likely be very low in relation to the overall fluid composition. This concept should be applicable to other systems where a fluoroelastomer surface is used in conjunction with a release fluid and where there is a component of the toner or ink that is soluble in or capable of reacting with silicone oil. The use of functional PFPE release fluids is promising in a wide variety of technologies as it could further reduce problematic side-reactions with ink, ink additives, paper debris, and the like elements that lead to early failure in marking subsystems.

In embodiments wherein a blend is used, the non-functional PFPE is used in an amount of from about 99 to about 60, or from about 90 to about 70 percent, or from 90 to about 80 percent by weight in combination with the functional fluorinated material. Similarly, the functional PFPE component is used in amounts of from about 1 to about 40 percent, or from about 10 to about 30 percent, or from about 10 to about 20 percent weight in combination with the non-functional PFPE material.

The combination of non-functional PFPE and functional PFPE fluid shows little interaction of the substituents to the copy substrate, such as paper. In this manner, the release agents do not prevent adhesives and POST IT® notes and other tabs from adhering adequately to copies or prints fused with these fluorinated release agents. In addition, the release agents spread better than known release agents on silicone rubber surfaces, and prevent swelling, which is a common problem. Moreover, the use of functional PFPE oils with non-functional PFPE oils reduces costs.

A nonfunctional oil, as used herein, refers to oils that do not interact or chemically react with the surface of the imaging member or with fillers on the surface. A functional oil, as used herein, refers to a release agent having functional groups, which chemically react with the fillers present on the surface of the imaging member or with the polymer itself, so as to reduce the surface energy of the fillers so as to provide better release of ink particles from the surface of the imaging member. If the surface energy is not reduced, the ink particles will tend to adhere to the imaging roll surface or to filler particles on the surface of the imaging roll, which will result in copy quality defects.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example I

Preparation of Functional Fluids

A perfluoropolyether fluid may be prepared or modified via several known synthetic methodologies in order to obtain pendant chemical structures relevant for enhancing the affinity of the fluid for various imaging member surfaces. The affinity between the functional pendant group may be obtained via polarity, charged ion or chemical bonding interactions. The desired chemical functional level in the concentrated fluid is from about 0.1 to about 2.0 mole percent. Lower values of from about 0.1 to about 0.5 mole percent fluids may not be diluted to functional levels desirable for the release agent application.

Example 2

Blended Fluid Composition

A prepared functional fluid concentrate fluid may be diluted with a non-functional fluid for the purpose of tailoring viscosity or functional level to a level appropriate for the intended application. Suitable blending fluids are sold under the trade names Krytox®, Fomblin®, Galden® or similarly available PFPE or fluorinated fluids. An example is a functional concentrated PFPE fluid of approximately 400 cS at 25° C. made to a functional level of 1.0 mole percent blended with a 400-800 cS at 25° C. non-functional PFPE fluid at a 1:9 ratio by weight. The resulting fluid has a viscosity of approximately 600 cS at 25° C. and a functional level of 0.1 mole percent.

Example 3

Functional PFPE Fluid Blend Use as Release Agent in Phase Chance Ink Application A fluid as fabricated in Examples 1 or 2 may be delivered to an imaging drum member or other imaging member for the purpose of maintaining separation between an imaging drum surface in continuous and variable contact with ink or ink components and those ink or ink components during printing operation. This fluid can be delivered to the desired surface by several known methods for delivering release agents in printing, providing superior results than currently employed release agents.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

We claim:

1. An offset printing apparatus for transferring a phase change ink onto a print medium comprising:

a) a phase change ink component for applying a phase change ink to form a phase change ink image;

b) an imaging member for accepting said phase change ink image from said phase change ink component, and transferring the phase change ink image from said imaging member to said print medium, the imaging member comprising:

i) an imaging substrate, and thereover ii) an outer layer; and iii) a release agent material coating, wherein the release agent material coating comprises a perfluorinated polyether having a skeleton selected from the group consisting of Formulas I and II, and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is selected from the group consisting of $CF_2$, CF—$CF_3$, and —$NR_4R_5$; $R_2$ is selected from the group consisting of $CF_2$, CF—$CF_3$, and —$NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 100 to about 500; and $$R_1—(CF_2CF_2)_m—O—(R_2R_2O)_n—(R_2O)_p—(CF_2)_q—CF_2—R_1 \quad \text{Formula II}$$

wherein $R_1$ is $CF_3$; $R_2$ is selected from the group consisting of $CF_2$ and CF—$CF_3$; m is a number of 0 or 1; n is a number of from about 0 to about 500; p is a number of from about 0 to about 100; q is a number of 0 or 1; and p+n is a number of from about 100 to about 500.

2. An offset printing apparatus in accordance with claim 1, wherein said perfluorinated polyether is a functional perfluorinated polyether and has a skeleton having the following Formula I:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is selected from the group consisting of $CF_2$, CF—$CF_3$, and —$NR_4R_5$; $R_2$ is selected from the group consisting of $CF_2$, CF—$CF_3$, and —$NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 100 to about 500.

3. An offset printing apparatus in accordance with claim 1, wherein said perfluorinated polyether is a nonfunctional perfluorinated polyether and has a skeleton having the following Formula II:

$$R_1—(CF_2CF_2)_m—O—(R_2R_2O)_n—(R_2O)_p—(CF_2)_q—CF_2—R_1 \quad \text{Formula II}$$

wherein $R_1$ is $CF_3$; $R_2$ is selected from the group consisting of $CF_2$ and CF—$CF_3$; m is a number of 0 or 1; n is a number of from about 0 to about 500; p is a number of from about 0 to about 100; q is a number of 0 or 1; and p+n is a number of from about 100 to about 500.

4. An offset printing apparatus in accordance with claim 1, wherein said outer layer comprises a coating comprising a material selected from the group consisting of a silicone rubber material and a fluoroelastomer.

5. An offset printing apparatus in accordance with claim 4, wherein said coating comprises a fluoroelastomer selected from the group consisting of a) copolymers of two of vinylidene fluoride, hexafluoropropylene and tetrafluoroethylene; b) terpolymers of vinylidene fluoride, hexafluoropropylene and tetrafluoroethylene; and c) tetrapolymers of vinylidene fluoride, hexafluoropropylene, tetrafluoroethylene, and a cure site monomer.

6. An offset printing apparatus in accordance with claim 1, wherein said coating comprises a thermoset.

7. An offset printing apparatus in accordance with claim 1, wherein said coating comprise a fluorosilicone.

8. An offset printing apparatus in accordance with claim 1, wherein said coating comprises a thermoplastic.

9. An offset printing apparatus in accordance with claim 1, wherein the release agent material coating has a viscosity of from about 75 to about 1,500 cS.

10. An offset printing apparatus in accordance with claim 1, wherein the release agent material coating has a viscosity of from about 200 to about 1,000 cS.

11. An offset printing apparatus in accordance with claim 3, wherein said release agent material coating further comprises a functional silicone blended with said nonfunctional perfluorinated polyether having a skeleton of Formula II.

12. An offset printing apparatus in accordance with claim 11, wherein said functional silicone is an amino-functional polydimethylsiloxane.

13. An offset printing apparatus in accordance with claim 11, wherein said functional silicone is present in said release agent material coating in an amount of from about 1 to about 40 percent by weight of said nonfunctional perfluorinated polyether.

14. An offset printing apparatus in accordance with claim 13, wherein said functional silicone is present in said release agent material coating in an amount of from about 10 to about 30 percent by weight of said nonfunctional perfluorinated polyether.

15. An offset printing apparatus in accordance with claim 1, further comprising an intermediate layer positioned between the substrate and the outer layer.

16. An offset printing apparatus in accordance with claim 15, wherein the intermediate layer comprises silicone rubber and said outer layer comprises a fluoroelastomer.

17. An offset printing apparatus in accordance with claim 1, wherein the imaging member substrate is in the form of a belt or a roller.

18. An offset printing apparatus in accordance with claim 17, wherein the imaging member substrate is in the form of a roller, and said substrate comprises aluminum.

19. An offset printing apparatus for printing a phase change ink onto a print medium comprising:

a) a phase change ink component for applying a phase change ink in a phase change ink image;

b) an imaging member for accepting said phase change ink image from said phase change ink component, and transferring the phase change ink image from said imaging member to said print medium and for fixing the phase change ink image to said print medium, the imaging member comprising:

i) an imaging substrate, and thereover ii) an outer layer comprising a fluoroelastomer; and iii) a release agent material coating, wherein the release agent material coating comprises a perfluorinated polyether having a skeleton selected from the group consisting of Formulas I and II and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

wherein $R_1$ is selected from the group consisting of $CF_2$, CF—$CF_3$, and —$NR_4R_5$; $R_2$ is selected from the group consisting of $CF_2$, CF—$CF_3$, and —$NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 100 to about 500; and $$R_1—(CF_2CF_2)_m—O—(R_2R_2O)_n—(R_2O)_p—(CF_2)_q—CF_2—R_1 \quad \text{Formula II}$$

wherein $R_1$ is $CF_3$; $R_2$ is selected from the group consisting of $CF_2$ and CF—$CF_3$; m is a number of 0 or 1; n is a number of from about 0 to about 500; p is a number of from about 0 to about 100; q is a number of aor 1; and p+n is a number of from about 100 to about 500; and c) a heating member associated with the offset printing apparatus.

20. An offset printing apparatus comprising:

a) a phase change ink component containing a phase change ink;

b) a imaging member comprising:

i) an imaging substrate, and thereover ii) an optional outer layer; and iii) a release agent material coating, wherein the release agent material coating comprises a perfluorinated polyether having a skeleton selected from the group consisting of Formulas I and II and mixtures thereof:

$$CF_3—(CF_2CF_2)_m—O—(R_1R_2O)—(R_3R_3O)_n—(R_3O)_p—(CF_2)_q—CF_3 \quad \text{Formula I}$$

wherein R1 is selected from the group consisting of $CF_2$, CF—$CF_3$, and —$NR_4R_5$; $R_2$ is selected from the group consisting of $CF_2$, CF—$CF_3$, and —$NR_4R_5$; $R_3$ is selected from the group consisting of $CF_2$ and $CF_3$; $R_4$ is selected from the group consisting of hydrogen, alkyl group having from about 1 to about 18 carbon atoms, arylalkyl group having from about 7 to about 18 carbon atoms, mercapto, hydride and carbinol functional group; $R_5$ is selected from the group consisting of alkyl having from about 1 to about 20 carbons, and a fluoroalkyl having from about 2 to about 10 carbons; m is a number of 0 or 1; n is a number of from about 0 to about 500; p is a number of from about 0 to about 100; q is a number of 0 or 1; and p+n is a number of from about 100 to about 500; and $$R_1—(CF_2CF_2)_m—O—(R_2R_2O)_n—(R_2O)_p—(CF_2)_q—CF_2—R_1 \quad \text{Formula II}$$

wherein $R_1$ is $CF_3$; $R_2$ is selected from the group consisting of $CF_2$ and CF—$CF_3$; m is a number of 0 or 1; n is a number of from about 0 to about 500; p is a number of from about 0 to about 100; q is a number of 0 or 1; and p+n is a number of from about 100 to about 500; and c) a heating member associated with said offset printing apparatus, wherein said phase change ink component dispenses said phase change ink onto said imaging member, and wherein said phase change ink is solid at about 25° C.

* * * * *